US006323409B1

(12) United States Patent
Surber

(10) Patent No.: US 6,323,409 B1
(45) Date of Patent: Nov. 27, 2001

(54) ORIGINAL SLIDE GUITAR CLIP

(75) Inventor: Tommy Nelson Surber, Shady Cove, OR (US)

(73) Assignee: Tommy Nelson Surber, Pittsburg, CA (US)

( * ) Notice: Subject to any disclaimer, the term of this patent is extended or adjusted under 35 U.S.C. 154(b) by 0 days.

(21) Appl. No.: 09/439,745

(22) Filed: Nov. 15, 1999

(51) Int. Cl.[7] ..... G10G 7/00
(52) U.S. Cl. ..... 84/453; 84/319; 84/329
(58) Field of Search ..... 84/453, 319, 329

(56) References Cited

U.S. PATENT DOCUMENTS 4,790,232 * 12/1988 Rosen ..... 84/329
5,739,445 * 4/1998 Terry et al. ..... 84/329
5,997,411 * 12/1999 Holub ..... 473/282

* cited by examiner

*Primary Examiner*—Shih-Yung Hsieh
(74) *Attorney, Agent, or Firm*—Tommy N. Surber

(57) ABSTRACT

The Original Slide Guitar Clip is designed to attach to either an Electric or an acoustic guitars body near base of the fretboard, without using screws, glue, adhesive tape or any other type of fasteners, making the slide clip easy to remove and reinstall. once installed it will hold either a metal or a glass slide near the fingertips of the player. the slide clip is double coated in a heavy duty flexible rubber that insures the guitars finish is not marred or damaged, yet holds firmly to the guitars body, at the same time holding the slide snugly yet allowing the player fast and easy access to it. The slide clip lightweight and can be fitted to almost any guitar.

1 Claim, 2 Drawing Sheets

FIG. 1.
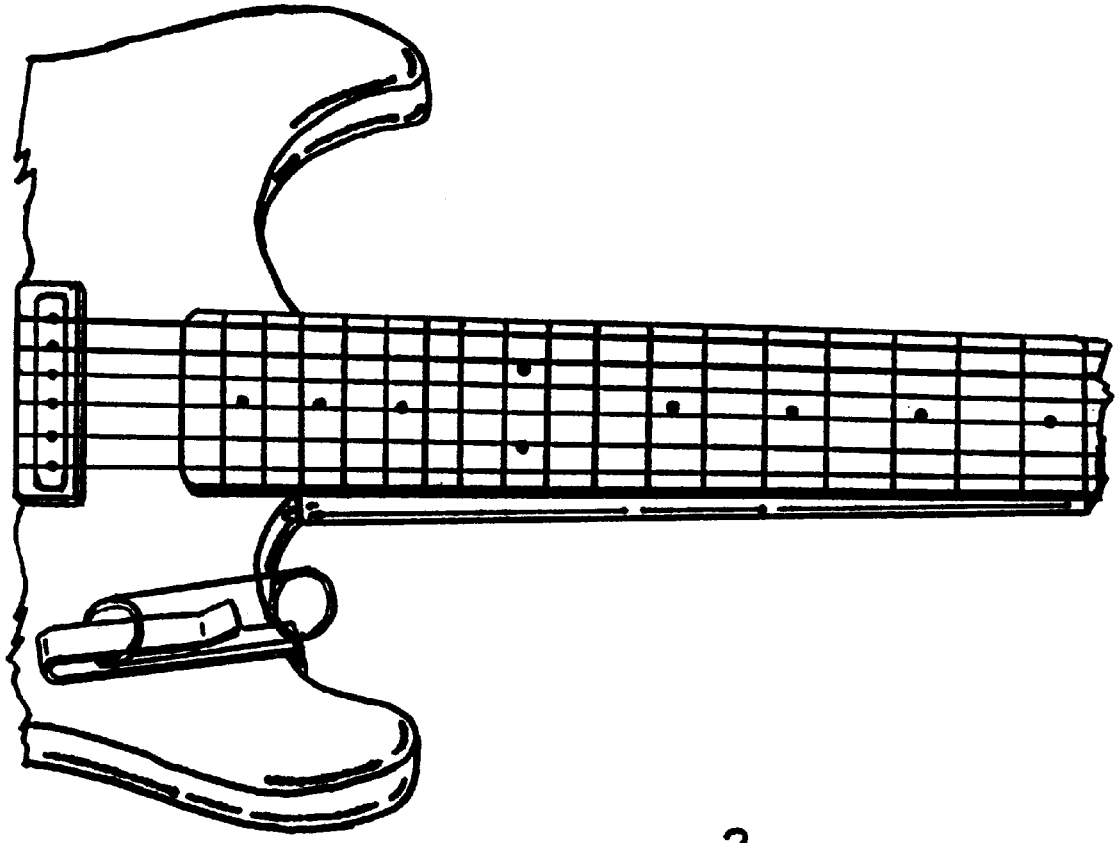
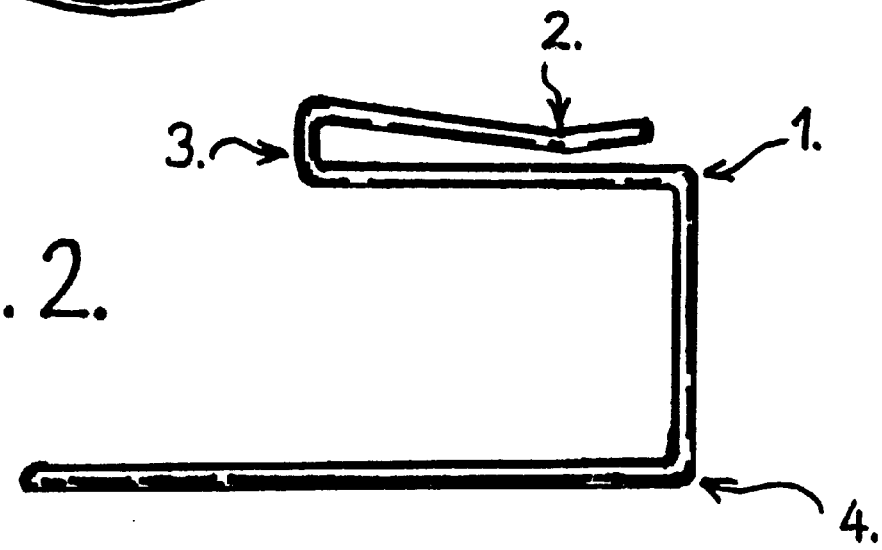
FIG. 2.

FIG. 3.
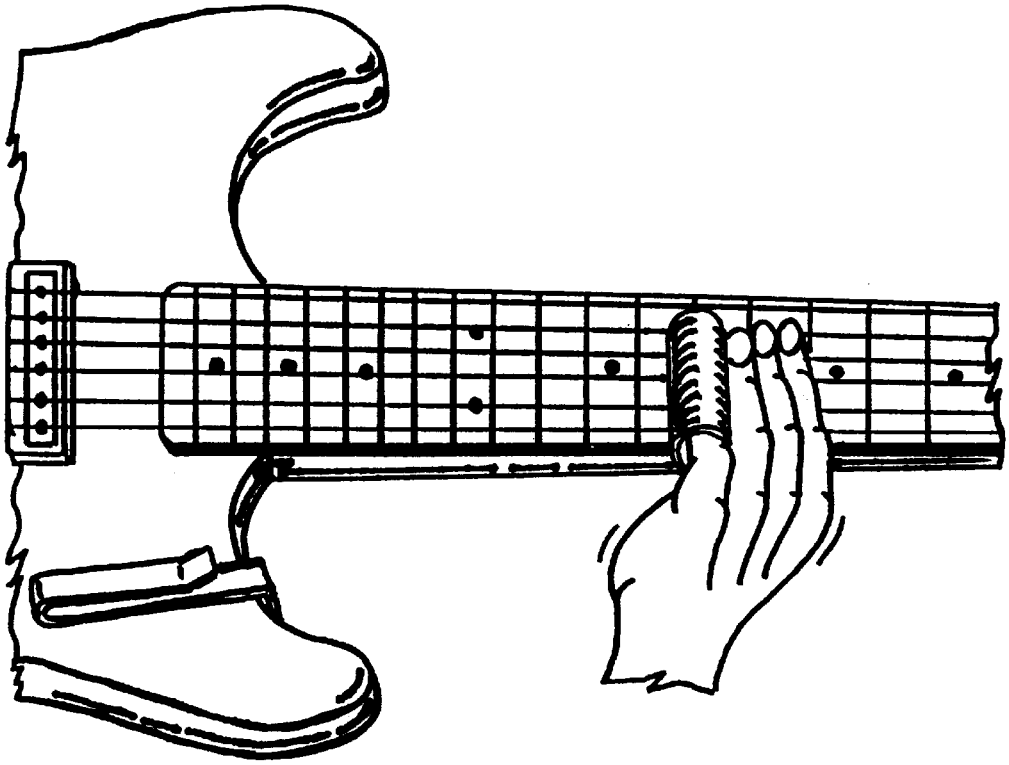
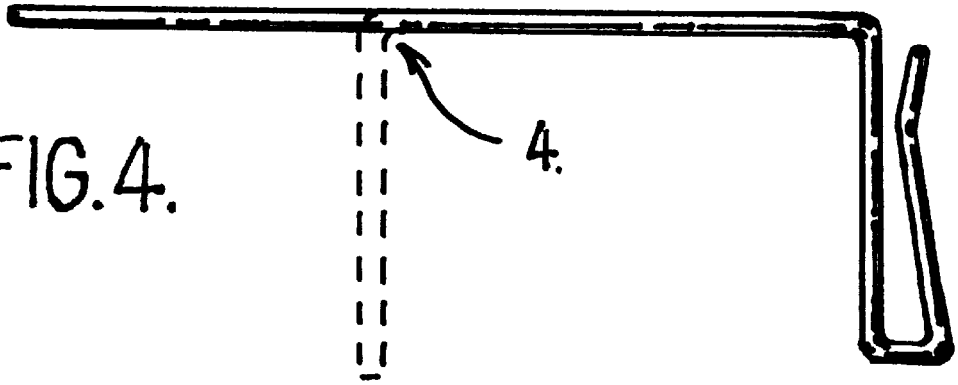
FIG. 4.

ORIGINAL SLIDE GUITAR CLIP

CROSS-REFERENCE TO RELATED APPLICATIONS

U.S. Pat. No. 4,790,232 December, 1998 Rosen 84/329 Holder for slide and pick.

U.S. Pat. No. 5,739,445 April, 1998 Terry 84/329 Guitar slide bar holder.

FEDERAL SPONSOR, RESEARCH OR DEVELOPMENT

Not Applicable

REFERENCE TO MICROFICHE

Not Applicable

BACKGROUND OF THE INVENTION

1. Field of Invention

The invention relates to a device for either an electric or an acoustic guitar that holds a metal or glass slide near the Musicians fingertips for fast and easy access while playing music.

2. Description of the Related Art

In the art of Guitar playing, some musicians will use a device known as a slide to create a sound on the Guitar better known to the general public as, Hawian Guitar or in Country Music as Pedal Steel Guitar, Lap Steel Guitar and in Delta Blues on the Dobro style Guitar. These particular instruments are designed so the musician can play them while in the setting position with the Guitar on the lap or on table legs in a Horizontal position. These Guitars also use a specific type of slide known as a slide bar made of a solid material, such as a heavy metal. Slide may also be played on any conventional style Guitar in the standing position using a tubular, hollow style slide made from materials such as, Steel, Aluminum, Glass, Porcelain, Plastic or any hollow material.

There are only two different style slides used by musicians. First, the Solid Bar as previously mentioned, is held in the hand by the fingers and is only used on Guitars played in the flat position such as Pedal Steel, Lap Steel, or Hawian style.

The second type is the Tubular style slide, also previously mentioned. This slide also has its own specific application, and that is to be used when the musician is standing with the instrument held by a guitar strap and the slide is placed on a finger of the fretting hand allowing the other fingers of that hand to fret single notes or chords. The Solid Bar slide is not used with this positioning of the guitar. Therefore it is not necessary to have a slide holder that can retain a Solid Bar slide on the guitar strap as shown in U.S. Pat. No. 5,739,445, also this particular device places the musicians slide up on the guitar strap, away from His or Her fretting hand, not allowing for fast and easy access. And as referred to in this Patent, various materials are used to make slide retaining portion of the holder, one being magnets which can create an interference with magnets on the pickups of an electric guitar.

It is also known that musicians regard their Guitars as being expertly crafted, precision instruments manufactured from rare materials with beautiful hand rubbed finishes, some of these guitars are very expensive, most are vintage and all increase in value if maintained in original manufacturers condition. Therefore the musician will not risk the chance of marring and possibly destroying the expensive finish on the guitar by applying a device to the instrument with any type of adhesive as shown in U.S. Pat. No. 4,790,232, making it necessary to use some type of chemical, scraper, or prying tool to remove the device, which may damage the Guitars finish permanently.

It therefore is the object of this invention to provide a slide clip that is safe, convenient and functional, that can be fit to the guitar by the musician, not requiring any mechanical knowledge and will store the slide near the fingertips of the musician, this invention also insures not to mar the instruments valuable finish.

BRIEF SUMMARY OF THE INVENTION

In executing the goals of this invention, the Original Slide Guitar Clip is manufactured from a single strip of 16 gauge galvanized sheet metal, ⅜ inch wide and 11 inches long, it is then dipped twice in a heavy duty, flexible rubber coating. The rubber coating insures the guitars expensive finish is not marred or damaged.

The unit is then bent in the general shape of an L, using a simple two pronged peg table. One leg of the slide clip is then bent at an approx. 20 degree angle, approx. ¾ inch from the tip, using the same peg table. This is to facilitate receiving a tubular slide easily.

That same leg is again bent at 2 and ½ inches from the tip, into a U shape. The U bend sweeps away from the long leg of the L forming a retention area for the tubular slide to be held while not in use.

The Original Slide Guitar Clip is easily fit to and installed on the guitar by the musician by simply measuring the guitars body thickness and bending the long leg of the L back towards the short leg forming a larger U shape the same thickness as the guitars body. The Slide Clip can then be easily installed or removed without harming the guitar It is furthermore the object of this invention to provide a place for the musician to store his or her guitar slide close to the fingertips where it is readily available and can be installed on the guitar without using screws, glue, adhesive tape nor any other type of fasteners. Also no magnets are used to retain a metal slide which is known to cause interference with the magnets of an electric guitars pickups.

BRIEF DESCRIPTION OF THE DRAWINGS

Drawing 1. comprises two views of the slide guitar clip.

FIG. 1. shows an electric guitar and how the clip relates to the guitars body and shown installed near the base of the fretboard with a glass slid closed to the fingertips of the musician.

FIG. 2. shows a side view of the clip with all the bends numbered, as mentioned in the summary and will be described below in the preferred embodiments.

Drawing 2. also shows two views of the slide guitar clip.

FIG. 3. again shows a guitar with a slide clip installed on the lower horn, close to the musician's fretting hand. Also showing how the slide, (In this case a metal slide) is used.

FIG. 4. again shows a side view of the slide clip as it is before it is bent by the musician, also in FIG. 4. is an example of how and where the musician might make the bend to fit the thickness of his or her guitar, seen at bend 4.

DETAILED DESCRIPTION OF THE INVENTION

The Original Slide Guitar Clip is a device built to attach to either an Acoustic or an Electric Guitars body and provide a place for the musician to store his or her Bottleneck, (Glass) or metal slide near the base of guitars fretboard, placing the slide close to the musicians fingertips, as shown in Drawing 1., View A. and Drawing 2., View A.

The invention known as the Original Slide Guitar Clip is simple to manufacture. It is made from 16 gauge galvanized sheet metal cut into strips ⅜ inch wide and 11 inches long, it is then double dipped into a heavy duty, flexible rubber coating, using the manufactures spec's. for the rubber product applied. The rubber coating helps the slide clip maintain a firm grip on the guitars body with out any type of adhesive tape, glue or fasteners such as screws and clamps.

The slide clip is then bent to the shape shown in Drawing 1., View B. which shows the 4 numbered bends with arrows indicating their location. All bends are made using a simple two pronged peg table, like a Work Mate brand work bench.

Bend 1. is made at 5 and ½ inches from one end of the clip forming a general L shape, one leg of the clip is then bent at approx. a 20 degree angle, approx, ¾ inch from the tip , Shown at Bend 2., this is to facilitate receiving a tubular type slide easily.

Bend 3 is on the same leg at 2 and ½ inches from the tip forming into a U shape. The U bend sweeps away from the long leg of the slide clip creating a retention area for the tubular slide to be stored when not in use.

Bend 4. is made by the buyer after purchase. The slide clip is fit to the guitar by the musician by simply measuring the guitars body thickness, at the base of the fretboard and then bending the long leg of the clip back towards the short leg forming a larger U shape the same thickness as the guitars body, also shown in Drawing 2., View B. The slide clip can then be easily installed or removed without harming the guitars valuable finish.

It will be appreciated that the slide guitar clip is easy to manufacture, lightweight, is pleasing to the eye, and easy to install furthermore manufactures are striving to make musicians lives easer by offering products with simplicity and utility. The slide guitar clip is in the sprit of the industry.

I claim:

1. A guitar clip device comprising a 16 guage galvanized sheet metal strip 11 inches long and ⅜ inch wide and being coated with rubber; said strip being bent into an L shape at 5½ inches from one tip of said strip to form a short leg and a long leg; said short leg being further bent into a U shape for recieving a tubular slide; said long leg being left straight allowing for a musician to bend into a U shape to fit the musician's guitar.

* * * * *